US010590938B2

(12) United States Patent
Lee et al.

(10) Patent No.: US 10,590,938 B2
(45) Date of Patent: Mar. 17, 2020

(54) IRREGULAR-PITCH REGENERATIVE BLOWER AND OPTIMIZATION DESIGN METHOD FOR SAME

(71) Applicant: KOREA INSTITUTE OF INDUSTRIAL TECHNOLOGY, Cheonan-si, Chungcheongnam-do (KR)

(72) Inventors: Kyoung-Yong Lee, Cheonan-si (KR); Young Seok Choi, Gwangmyeong-si (KR); Jin Hyuk Kim, Incheon (KR); Uk Hee Jung, Cheonan-si (KR)

(73) Assignee: Korea Institute of Industrial Technology, Cheonan-si, Chungcheongnam-do (KR)

( * ) Notice: Subject to any disclaimer, the term of this patent is extended or adjusted under 35 U.S.C. 154(b) by 409 days.

(21) Appl. No.: 15/533,175

(22) PCT Filed: Dec. 2, 2015

(86) PCT No.: PCT/KR2015/013040

§ 371 (c)(1),
(2) Date: Jun. 5, 2017

(87) PCT Pub. No.: WO2016/089103

PCT Pub. Date: Jun. 9, 2016

(65) Prior Publication Data

US 2017/0363091 A1 Dec. 21, 2017

(30) Foreign Application Priority Data

Dec. 4, 2014 (KR) ..... 10-2014-0172727

(51) Int. Cl.
*F04D 23/00* (2006.01)
*F04D 29/66* (2006.01)
(Continued)

(52) U.S. Cl.
CPC ..... *F04D 23/008* (2013.01); *F04D 5/002* (2013.01); *F04D 29/18* (2013.01); *F04D 29/666* (2013.01)

(58) Field of Classification Search
CPC ..... F04D 23/008; F04D 5/002; F04D 29/18; F04D 29/663; F04D 29/666
See application file for complete search history.

(56) References Cited

U.S. PATENT DOCUMENTS 4,923,365 A 5/1990 Mathias
8,092,186 B2 * 1/2012 Jang ..... F04D 5/002 415/55.1

(Continued)

FOREIGN PATENT DOCUMENTS

JP 2003-278684 A 10/2003
JP 2003-336591 A 11/2003

(Continued)

OTHER PUBLICATIONS

Addison-Wesley, Bradley, Hax, Magnanti, "Applied Mathematical Programming", 1977, MIT, http://web.mit.edu/15.053/www/AppliedMathematicalProgramming.pdf (Year: 1977).*

*Primary Examiner* — Brian P Wolcott
(74) *Attorney, Agent, or Firm* — Rabin & Berdo, P.C.

(57) ABSTRACT

Provided is a regenerative blower. According to an illustrative embodiment of the present invention, the regenerative blower comprises an impeller comprising a plurality of blades disposed spaced apart in the circumferential direction, wherein, in the plurality of blades, each blade gap is arranged at an incremental angle (ΔΘi).

17 Claims, 7 Drawing Sheets

(51) Int. Cl.
*F04D 5/00* (2006.01)
*F04D 29/18* (2006.01)

(56) References Cited

U.S. PATENT DOCUMENTS

| | | | | |
|---|---|---|---|---|
| 9,599,126 | B1 * | 3/2017 | Sagher | F04D 29/666 |
| 2003/0175111 | A1 | 9/2003 | Miura et al. | |
| 2006/0120853 | A1 | 6/2006 | Narisako et al. | |
| 2010/0054949 | A1 | 3/2010 | Jang et al. | |

FOREIGN PATENT DOCUMENTS

| | | | |
|---|---|---|---|
| JP | 2006-161723 | A | 6/2006 |
| JP | 5001975 | B2 | 8/2012 |
| KR | 10-0872294 | B1 | 12/2008 |

* cited by examiner

IRREGULAR-PITCH REGENERATIVE BLOWER AND OPTIMIZATION DESIGN METHOD FOR SAME

TECHNICAL FIELD

The present disclosure relates to a regenerative blower and a design optimization method for the same.

BACKGROUND ART

Regenerative blowers are generally used for transferring gas at a relatively low flow-rate and in a relatively high pressure, as in an industrial high-pressure blower (or a ring blower). Recently, the application range thereof is expanding to an air supply of a fuel cell system, a hydrogen recirculation system, and the like.

Such regenerative blowers are divided into an open channel type used as an air supply blower of a system requiring a low flow-rate and a high head and a side channel type. In the regenerative blower, blades are located in the circumferential direction of a disk-shaped rotary impeller. When the regenerative blower operates, internal circulation occurs between the recesses between the blades and the channels of a casing, thereby increasing pressure.

The regenerative blower must have a plurality of blades to raise the head. This consequently forms blade-passing frequencies (BPFs), i.e. high-frequency noise, and nose (overall noise). Although the noise of the regenerative blower can generally be reduced by reducing the number of revolutions by improving efficiency and relative performance, the noise reduction ability is limited.

In addition, when the regenerative blower is used for home and medical uses, a method of reducing noise using a muffler can be used. However, this method increases the cost and size of the regenerative blower and has a loss in flow rate of about 10% caused by the muffler.

Since the arrangement of the blades of the regenerative blower of the related art is controlled by a random number method, it is difficult to predict or adjust noise and efficiency based on the arrangement of the blades, which is problematic.

In addition, although the blades of the regenerative blower of the related art are arranged at unequal pitches by the random number method, the basis of the arrangement is insufficient and adjustment is difficult, which are problematic.

DISCLOSURE

Technical Problem

An embodiment of the present disclosure provides a regenerative blower and a design optimization method for the same in which blades are arranged at unequal pitches, such that the noise and efficiency due to the arrangement of the blades can be predicted or adjusted.

Technical Solution

According to an aspect of the present disclosure, provided is a regenerative blower including an impeller including a plurality of blades arranged in a circumferential direction to be spaced part from each other. The plurality of blades are arranged such that angles therebetween are incremental angles ΔΘi satisfying the formula:

$$\Delta\theta_i = \left(\frac{360}{N}\right) + (-1)^i \times Am \times \mathrm{Sin}\left(P_i \times \frac{360}{N} \times i\right) \times \mathrm{Cos}\left(P_2 \times \frac{360}{N} \times i\right)$$

Here, the N is a total number of the blades, where the N is a natural number greater than 2.

The Am is a distribution size of distances between the blades (equal angles), where 0°<Am<360°/N.

The i is a sequence of the blades, where the i=1, 2, 3, 4, . . . , and N.

The P1 and the P2 are factors having an effect on a period, where 0≤P1≤N, and 0≤P2≤N, the P1 and the P2 being real numbers.

In addition, the Am, the P1, and the P2 may satisfy both relationships 27≤η≤32 and 77 dB(A)≤SPL≤83.7 dB(A).

In this case, $\eta=(P_{out}-P_{in})Q/\sigma\omega$, and $SPL=10\log_{10}(P/P_{ref})^2$.

Here, the η is efficiency, the SPL is a sound pressure level (SPL), the $(P_{out}-P_{in})$ is a total pressure, the Q is a volumetric flow, the σ is a torque, the ω is an angular velocity, the P is a sound pressure, and the $P_{ref}$ is a reference pressure ($2\times10^{-5}$ Pa).

In addition, the Am may range from 1° to 8.23°.

Furthermore, the P1 may range from 1 to 38, and the P2 ranges from 0 to 39.

According to another aspect of the present disclosure, provided is a design optimization method for the above-described regenerative blower. The design optimization method may include: a design variable and objective function selection step; a design area setting step of determining upper and lower limits of design variables; and a step of obtaining optimal solutions for objective functions in a design area.

The design optimization method may further include a step of comparing whether or not the optimal solutions, obtained in the step of obtaining the optimal solutions for the objective functions in the design area, are proper.

In the design variable and objective function selection step, the design variables may include the Am, indicating the distribution size of the distances between the blades, and the P1 and the P2, indicating the factors having an effect on the period, and the objective functions may include the η, indicating the efficiency, and the SPL, indicating the sound pressure level.

In addition, in the design area setting step of determining the upper and lower limits of the design variables, the Am may range from 1 to 8.23, the P1 may range from 1 to 38, and the P2 may range from 0 to 39.

Furthermore, the step of obtaining the optimal solutions for the objective functions in the design area may include: determining a plurality of test points by Latin hypercube sampling in the design area; and obtaining the objective functions at the plurality of test points by aerodynamic performance test and noise test.

In addition, the step of obtaining the optimal solutions for the objective functions in the design area may include obtaining response surfaces, on which the optimal solutions are to be calculated, using a response surface method.

Furthermore, when the response surface method is used, a response surface analysis (RSA) model of the objective functions may have function types: the η is $-18.8659-17.9578Am-10.5773P1-21.7493P2+7.3846AmP1+17.3858AmP2-0.789P1P2+6.2258Am^2+11.0769P1^2+16.1141P2^2$, and the SPL is $84.2304+4.2557Am-11.8326P1-6.4429P2+8.2626AmP1+4.8169AmP2+5.9802P1P2-4.2959Am^2+4.7855P1^2+1.2078P2^2$.

In addition, after the step of obtaining the response surfaces, on which the optimal solutions are to be calculated, using the response surface method, the optimal solutions able to maximize the objective functions, based on the response surfaces of the objective functions obtained by the response surface method, may be obtained using a multi-objective evolutionary algorithm.

Furthermore, after the optimal solutions able to maximize the objective functions are obtained, more improved values of the optimal solutions may be obtained by localized search for the objective functions, using sequential quadratic programming (SQP), which is a gradient-based search algorithm.

In addition, the step of comparing whether or not the optimal solutions are proper may include analysis of variance (ANOVA) and regression analysis on the response surfaces of the objective functions obtained by the response surface method.

Advantageous Effects

The regenerative blower and the design optimization method for the same according to embodiments of the present disclosure are designed by multi-objective optimization, thereby allowing efficiency and noise to be selectively adjusted.

MODE FOR INVENTION

Figure 1:
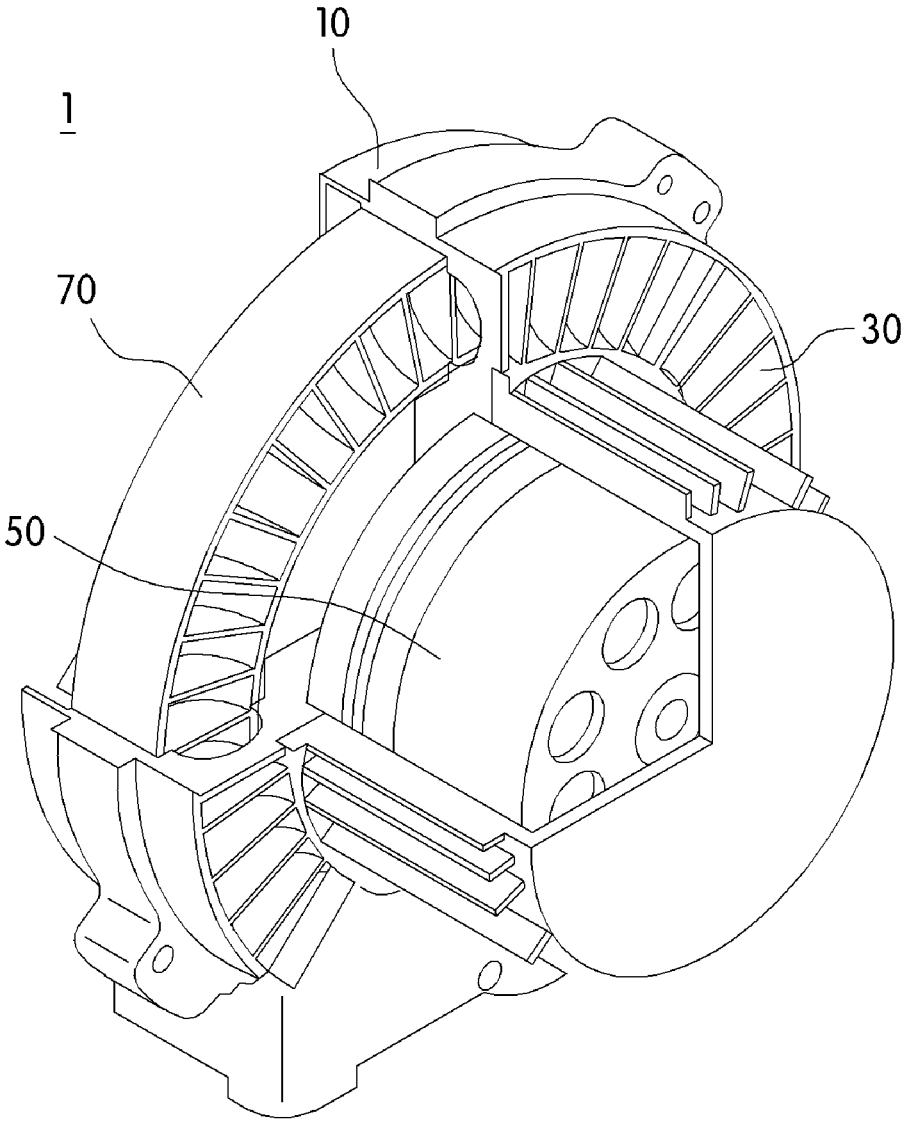
FIG. 1 is a schematic view illustrating a regenerative blower according to an embodiment of the present disclosure.

Hereinafter, reference will be made to the present disclosure in detail, embodiments of which are illustrated in the accompanying drawings and described below, so that a person having ordinary skill in the art to which the present disclosure relates could easily put the present disclosure into practice. It should be understood that the present disclosure is not limited to the following embodiments but various changes in forms may be made. Throughout the drawings, the same reference numerals and symbols will be used to designate the same or like components, and specific portions will be omitted for the sake of brevity.

Hereinafter, a regenerative blower and a design optimization method for the same according to an embodiment of the present disclosure will be described in more detail with reference to the accompanying drawings.

Figure 2:
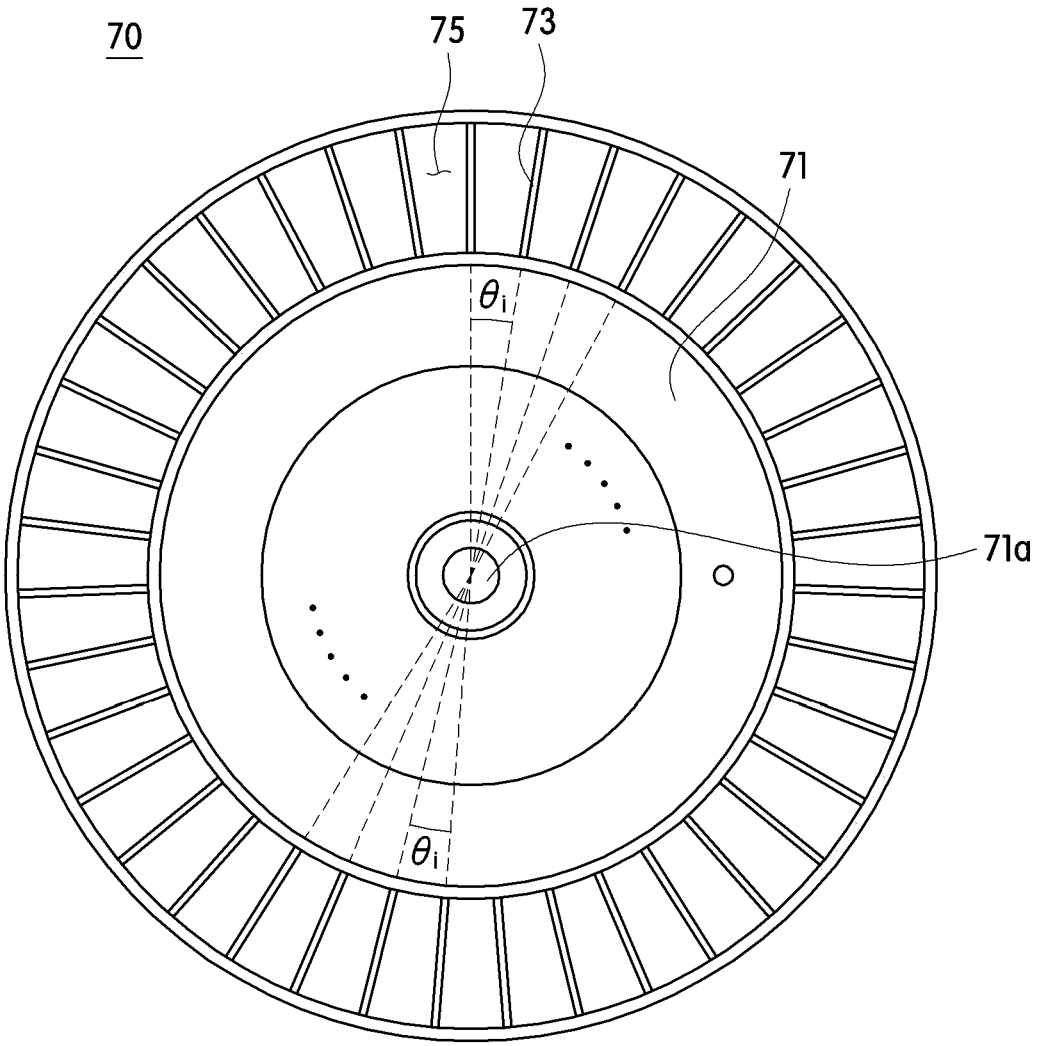
FIG. 2 is a plan view illustrating an impeller of the regenerative blower according to the embodiment of the present disclosure.

FIG. 1 is a schematic view illustrating a regenerative blower according to an embodiment of the present disclosure, and FIG. 2 is a plan view illustrating an impeller of the regenerative blower according to the embodiment of the present disclosure.

Referring to FIGS. 1 and 2, a regenerative blower 1 according to the embodiment of the present disclosure includes an impeller 70, a first casing 10, a second casing 30, and a motor 50.

Referring to FIG. 1, in the regenerative blower 1 according to the embodiment of the present disclosure, the impeller 70 is rotatably disposed within a pair of casings, i.e. the first casing 10 and the second casing 30, which are divided to the right and left. Here, the impeller 70 is disposed on a rotary shaft (not shown) of the motor 50 to be rotated by the motor.

Figure 3:
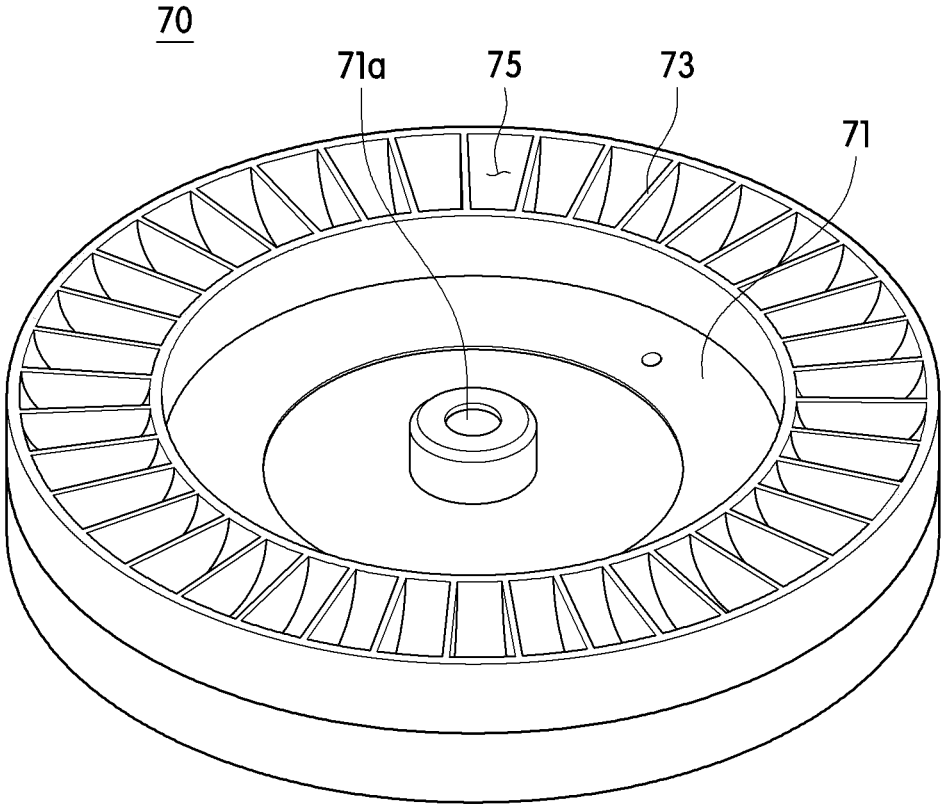
FIG. 3 is a perspective view illustrating a modification of the impeller of the regenerative blower according to the embodiment of the present disclosure.
Figure 4:
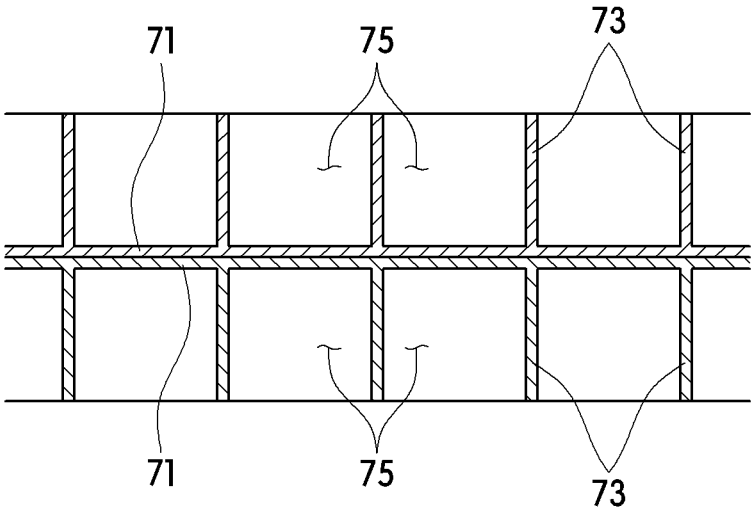
FIG. 4 is a cross-sectional view illustrating a cross-section of FIG. 3.

FIG. 3 is a perspective view illustrating a modification of the impeller of the regenerative blower according to the embodiment of the present disclosure, and FIG. 4 is a cross-sectional view illustrating a cross-section of FIG. 3.

Hereinafter, the impeller of the regenerative blower according to the embodiment of the present disclosure will be described.

Each of the impeller 70 of the regenerative blower 1 according to the embodiment of the present disclosure includes a disk 71 and a plurality of blades 73.

Referring to FIGS. 2 to 4, the disk 71 has a shaft fixing portion 71*a* provided on the central portion to be fixedly connected to the rotary shaft (not shown) of the regenerative blower 1. The plurality of blades may be arranged in the circumferential direction to be spaced apart from each other, on one side of the impeller as illustrated in FIG. 2 or on both sides of the impeller as illustrated in FIGS. 3 and 4.

Hereinafter, the regenerative blower 1 according to the embodiment of the present disclosure having a plurality of blades on one side of the disk will be described. However, the present disclosure is not limited thereto, and as illustrated in FIGS. 3 and 4, a plurality of blades may be disposed on both sides of the disk such that the blades are spaced apart from each other.

The shaft fixing portion 71*a* is fixedly connected to the rotary shaft of the regenerative blower 1, i.e. the rotary shaft of the motor, such that the disk 71 rotates along with the rotary shaft.

Flow recesses 75 are provided between the plurality of blades, with the cross-section thereof being semicircular or semi-elliptical. However, the present disclosure is not limited thereto. Since the flow recesses 75 are formed between the plurality of blades, the plurality of flow recesses 75 are spaced apart from each other.

The plurality of blades 73 are arranged at unequal pitches instead of being arranged at equal pitches such that the angles Θi between the blades are unequal.

In the regenerative blower according to the embodiment of the present disclosure, the blades can be arranged at unequal pitches, due to the angles between the blades being set to incremental angles ΔΘi according to Formula 1.

$$\Delta\theta_i = \left(\frac{360}{N}\right) + (-1)^i \times Am \times \mathrm{Sin}\left(P_i \times \frac{360}{N} \times i\right) \times \mathrm{Cos}\left(P_2 \times \frac{360}{N} \times i\right), \quad \text{[Formula 1]}$$

where N is the total number of the blades (N is a natural number greater than 2), Am is a distribution size of the distances between the blades (equal angles) (0°<Am<360°/N), i is a sequence of the blades (i=1, 2, 3, 4, . . . , and N), and P1 and P2 are factors having an effect on the period (0≤P1≤N, and 0≤P2≤N, where P1 and P2 are real numbers).

Here, according to a reference shape, the blades of the impeller shall be arranged at equal pitches due to the same angles between the blades, and the sum of the incremental angles ΔΘi shall satisfy 360°.

Due to the incremental angles ΔΘi, the impeller 70 can satisfy an unequal pitch condition having the same structure even in the case in which the number of the blades 73 changes. In addition, since generated functions have the shape of an oscillation divergence function due to a term $(-1)^i$, the average of the incremental angles can be set to be similar to an overall average.

In the regenerative blower 1 according to the embodiment of the present disclosure, the time intervals of the blades 73 and the blades passing through the adjacent partitions are scattered. This consequently reduces high-frequency sound and disperses sound pressure throughout a plurality of frequency bands, thereby reducing blade-passing frequency (BPF) in the high-frequency region.

For example, when the total number of blades is N=39, the average of the angles of the blades is 360°/39=9.2°.

To satisfy the conditions presented in the above formula, Am indicating the distribution size of the distances of the blades (equal angles), as well as the factors P1 and P2 having an effect on the period, are controlled. Since a pitch condition similar to a random pitch condition and a pitch condition having a predetermined distance can be generated by controlling the values Am, P1, and P2, it is possible to easily predict and adjust the arrangement of the blades.

Figure 5:
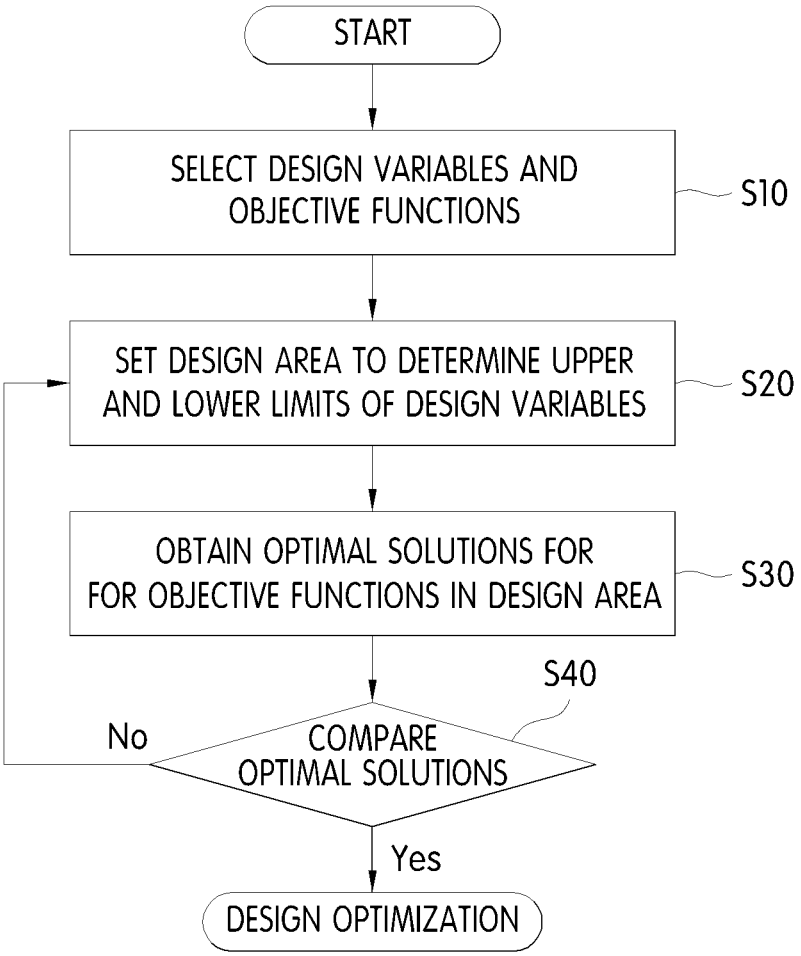
FIG. 5 is a flowchart illustrating a design optimization method according to an embodiment of the present disclosure.

FIG. 5 is a flowchart illustrating a design optimization method according to an embodiment of the present disclosure.

The design optimization method for the regenerative blower according to the embodiment of the present disclosure can adjust both the efficiency and noise of the regenerative blower by modifying the distances of the blades to unequal pitches using multi-objective optimization.

In the design optimization method for the regenerative blower according to the embodiment of the present disclosure, optimization refers to ability to adjust efficiency and noise as required, compared to the reference shape of the impeller having equal pitches. That is, it is possible to improve both efficiency and noise, improve efficiency alone, or improve noise alone. In this regard, according to the embodiment of the present disclosure, the design optimization method for the regenerative blower includes design variable and objective function selection step S10, design area setting step S20 of determining upper and lower limits of design variables, step S30 of obtaining optimal solutions for objective functions in a design area, and optimal solution comparison step S40.

The design optimization method for the regenerative blower according to the embodiment of the present disclosure selects design variables for the regenerative blower 10 and optimizes objective functions within the design area.

First, in the design variable and objective function selection step S10, the objective functions are obtained by aerodynamic and noise performance test, and design variables for determining the unequal pitches of the blades are set in order to optimize the obtained objective functions.

According to the present embodiment, in the design variables Am, P1, and P2, Am is the distribution size of the distances of the blades (equal angles) (0°<Am<360/N°), while P1 and P2 are factors having an effect on the period (0<P1<N, and 0≤P2≤N, where P1 and P2 are real numbers).

The geometric parameters Am, P1, and P2 related to the unequal pitches of the blades 73 can be used as design values to optimize both efficiency η and a sound pressure level SPL in the regenerative blower 1. In this case, it is important to determine a formed movable design space by establishing the ranges of the design variables.

In addition, since the regenerative blower 1 according to the embodiment of the present disclosure is intended to optimize both efficiency and noise by optimizing the shape of the unequal pitches of the blades, the objective functions can be set using the efficiency η and the sound pressure level SPL.

Afterwards, in the design area setting step S20 of determining upper and lower limits of design variables, the ranges of the design variables are defined for the realization of design optimization, thereby setting a proper design range.

The upper and lower limits of the design variables to be changed during the process of design optimization can be determined by the minimum thickness of a drill or a blade used for the fabrication of the impeller. When the design variables set by the inventors of the present disclosure are applied to Formula 1, the upper and lower limits are obtained as in Table 1.

TABLE 1

| Variables | Minimum | Maximum |
|---|---|---|
| Am | 1 degree | 8.23 degrees |
| P1 | 1 | 38 |
| P2 | 0 | 39 |

According to the embodiment of the present disclosure, the design variable Am ranges from 1° to 8.23°, the design variable P1 ranges from 1 to 38, and the design variable P2 ranges from 0 to 39.

Afterwards, in the test step S30, values of the object function are determined, for example, at 30 test points by performing a test in the set design area.

Here, the 30 test points can be determined by Latin hypercube sampling (LHS) available for sampling specific test points in the design area having a multidimensional distribution. The objective functions η and SPL at 30 test points can be obtained by aerodynamic performance test and noise test.

In the optimal solution comparison step S40 of obtaining optimal solutions for the objective functions in the design area based on the test result, response surfaces on which optimal points will be calculated can be formed using a response surface method, namely, a type of surrogate model.

Various types of hydrodynamic performance of the regenerative blower 10 according to the embodiment of the present disclosure can be improved by multi-objective optimization of the regenerative blower 10. The object of optimization is to optimize both the efficiency η and sound pressure level SPL of the regenerative blower. Here, η and SPL, objective functions for the design optimization of the regenerative blower, can be defined as follows:

$$\eta = \frac{(P_{out} - P_{in}) \cdot Q_v}{\sigma \cdot \omega} \quad \text{[Formula 2]}$$

-continued $$SPL = 10\log_{10}(p/p_{ref})^2 \quad \text{[Formula 3]}$$

Here, η is efficiency, SPL is a sound pressure level, $(P_{out}-P_{in})$ is a total pressure, Q is a volumetric flow, σ is a torque, ω is an angular velocity, P is a sound pressure, and $P_{ref}$ is a reference pressure ($2\times10^{-5}$ Pa).

The response surface method is a mathematical/statistical method of modeling an actual response function into an approximate polynomial function by using results obtained from physical tests or numerical calculations.

The response surface method can reduce the number of tests by modeling responses in a space using a limited number of tests. Response surfaces defined by a secondary polynomial used herein can be expressed as follows:

$$f(x) = C_0 + \sum_{j=1}^{n} C_j\chi_j + \sum_{j=1}^{n} C_{ji}\chi_j^2 + \sum\sum_{i+j}^{n} C_{ij}\chi_i\chi_j \quad \text{[Formula 4]}$$

Here, C indicates a regression coefficient, n indicates the number of design variables, and x indicates design variables.

In this case, the regression coefficient is represented by Formula 5:

$$(C_0, C_1, \text{etc}) = (n+1)\times(n+2)/2 \quad \text{[Formula 5]}$$

Here, the function type of an response surface analysis (RSA) model of the objective functions according to the embodiment of the present disclosure can be expressed, with respect to normalized design variables, as follows:

$$\eta = -1838659 - 19.9878Am - 10.5773P1 - 21.7493P2 + 7.3846Am\cdot P1 + 17.3858Am\cdot P2 - 0.789P1\cdot P2 + 6.2258Am^2 + 11.0769P1^2 + 16.1141P2^2 \quad \text{[Formula 6]}$$

$$SPL = 84.2304 + 4.2557Am - 11.8326P1 - 6.4429P2 + 8.2626Am\cdot P1 + 4.8169Am\cdot P2 + 5.9802P1\cdot P2 - 4.2959Am^2 + 4.7855P1^2 + 1.2078P2^2 \quad \text{[Formula 7]}$$

Afterwards, η and SPL satisfying Formulae 6 and 7 are obtained.

In addition, according to the embodiment of the present disclosure, in order to optimize both η and SPL, a multi-objective evolutionary algorithm able to maximize the objective functions, based on the response surfaces of the objective functions obtained by the response surface method, can be used.

The multi-objective evolutionary algorithm may be implemented as real-coded NSGA-II developed by Deb. Here, the term "real coded" means that crossing and variation are performed in the actual design space to form the response of NSGA-II.

The optimal points obtained by the multi-objective evolutionary algorithm are referred to as a Pareto optimal solution, i.e. an assembly of non-dominant solutions. The Pareto optimal solution allows intended optimal solutions to be selected according to the intention of the objective to be used.

Since the multi-objective evolutionary algorithm is well-known in the art, a detailed description thereof will be omitted.

In addition, optimal points can be found by evaluating values of objective functions for test points, obtained by Latin hypercube sampling (LHS), and using sequential quadratic programming (SQP) based on the evaluated objective functions.

More improved optimal solutions for the objective functions can be obtained by localized search for objective functions from solutions predicted by initial NSGA-II, using sequential quadratic programming (SQP), i.e. a gradient-based search algorithm.

Here, SQP is a well-known method for optimizing non-linear objective functions under nonlinear constraints, and thus a detailed description thereof will be omitted.

Consequently, Pareto optimal solutions, i.e. an assembly of non-dominant solutions, can be obtained by discarding dominant solutions from the optimal solutions improved as above ant then removing overlapping solutions. A group of units categorized among the Pareto optimal solutions will be referred to as a cluster.

Figure 6:
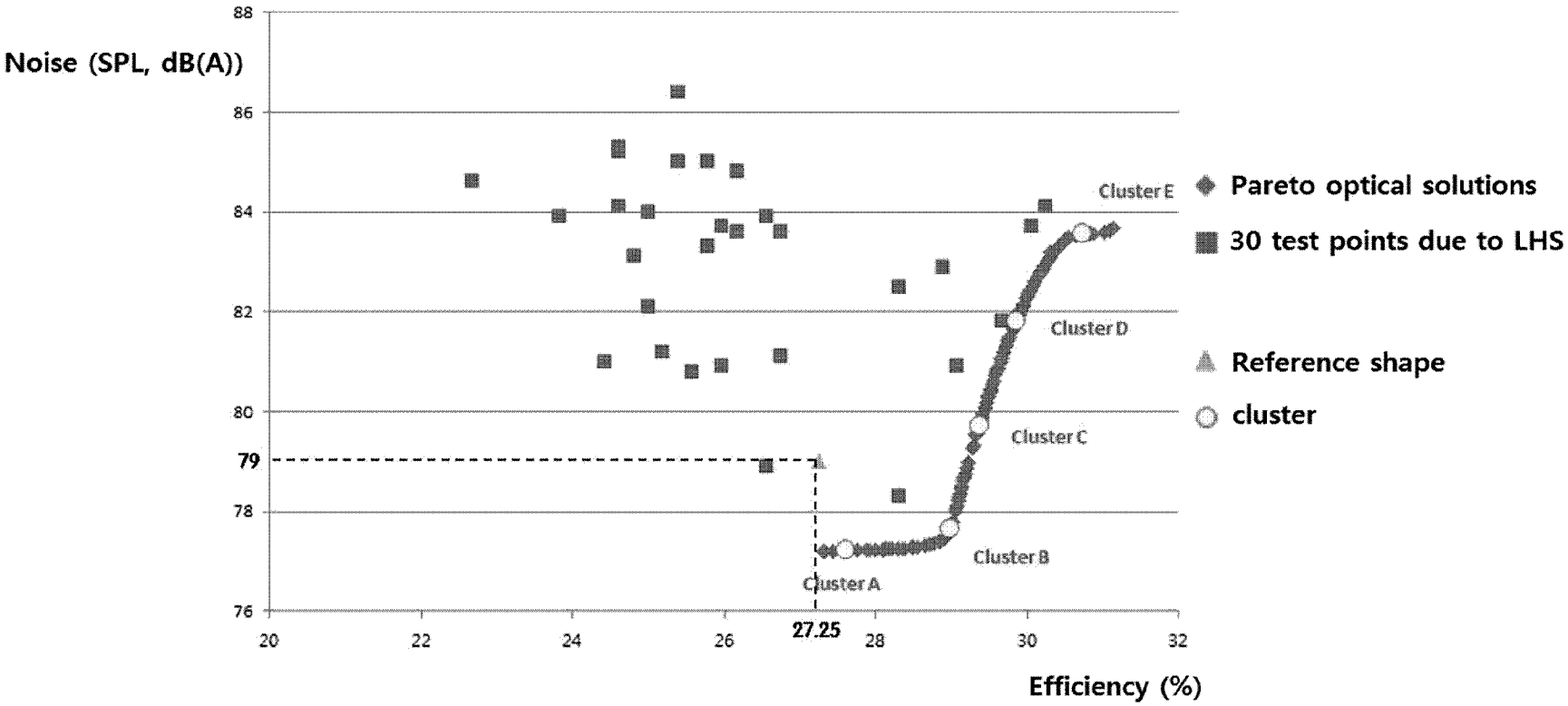
FIG. 6 is a graph illustrating the efficiencies of objective functions and sound pressure levels in the design optimization method for the regenerative blower according to the embodiment of the present disclosure.

FIG. 6 is a graph illustrating the efficiencies of Pareto optimal solutions (clustered optimal solutions (COSs)) and sound pressure levels, derived from the multi-objective numerical optimization method for the regenerative blower according to the embodiment of the present disclosure.

Referring to FIG. 6, Pareto optimal solutions can have an S-shaped profile due to the optimization of objective functions regarding efficiency and noise. A trade-off analysis shows the correlation between two objective functions.

Thus, in the regenerative blower 1 according to the embodiment of the present disclosure, a higher efficiency can be obtained at a higher noise level, and in contrast, a lower efficiency can be obtained at a lower noise level.

As illustrated in FIG. 6, Am, P1, and P2 can satisfy both relationships 2732 and 77 dB(A)≤SPL≤83.7 dB(A). Am, P1, and P2 values satisfying these relationships, corresponding to the graph of the Pareto optimal solutions illustrated in FIG. 6, are represented in Table 2.

TABLE 2

| Design Variable | | | Objective Function | |
|---|---|---|---|---|
| Am | P1 | P2 | Efficiency (η) | Noise (SPL · dB(A)) |
| X1 | Y1 | Z1 | 31.139 | 83.6854983 |
| X2 | Y2 | Z2 | 31.139 | 83.685049 |
| X3 | Y3 | Z3 | 31.082 | 83.6160881 |
| X4 | Y4 | Z4 | 31.078 | 83.6160881 |
| X5 | Y5 | Z5 | 31.078 | 83.614491 |
| X6 | Y6 | Z6 | 31.031 | 83.6011141 |
| X7 | Y7 | Z7 | 31.009 | 83.5965554 |
| X8 | Y8 | Z8 | 30.877 | 83.5760955 |
| X9 | Y9 | Z9 | 30.85 | 83.5727465 |
| X10 | Y10 | Z10 | 30.818 | 83.5689124 |
| X11 | Y11 | Z11 | 30.812 | 83.5689124 |
| X12 | Y12 | Z12 | 30.812 | 83.5682137 |
| X13 | Y13 | Z13 | 30.723 | 83.5586193 |
| X14 | Y14 | Z14 | 30.708 | 83.5586193 |
| X15 | Y15 | Z15 | 30.708 | 83.5571499 |
| X16 | Y16 | Z16 | 30.656 | 83.5519518 |
| X17 | Y17 | Z17 | 30.656 | 83.5519518 |
| X18 | Y18 | Z18 | 30.656 | 83.5519497 |
| X19 | Y19 | Z19 | 30.63 | 83.5494975 |
| X20 | Y20 | Z20 | 30.63 | 83.5494974 |
| X21 | Y21 | Z21 | 30.63 | 83.549457 |
| X22 | Y22 | Z22 | 30.551 | 83.500479 |
| X23 | Y23 | Z23 | 30.542 | 83.4892842 |
| X24 | Y24 | Z24 | 30.513 | 83.4502087 |
| X25 | Y25 | Z25 | 30.508 | 83.4434578 |
| X26 | Y26 | Z26 | 30.489 | 83.4152326 |
| X27 | Y27 | Z27 | 30.484 | 83.4152326 |
| X28 | Y28 | Z28 | 30.484 | 83.4082556 |
| X29 | Y29 | Z29 | 30.422 | 83.3067451 |
| X30 | Y30 | Z30 | 30.409 | 83.3067451 |
| X31 | Y31 | Z31 | 30.409 | 83.2855466 |
| X32 | Y32 | Z32 | 30.384 | 83.2389053 |
| X33 | Y33 | Z33 | 30.38 | 83.2324381 |
| X34 | Y34 | Z34 | 30.357 | 83.1882198 |
| X35 | Y35 | Z35 | 30.311 | 83.1882198 |

TABLE 2-continued

| Design Variable | | | Objective Function | |
|---|---|---|---|---|
| Am | P1 | P2 | Efficiency (η) | Noise (SPL · dB(A)) |
| X36 | Y36 | Z36 | 30.311 | 83.0936043 |
| X37 | Y37 | Z37 | 30.303 | 83.0771505 |
| X38 | Y38 | Z38 | 30.301 | 83.0771505 |
| X39 | Y39 | Z39 | 30.301 | 83.0730728 |
| X40 | Y40 | Z40 | 30.277 | 83.0206437 |
| X41 | Y41 | Z41 | 30.271 | 83.0065799 |
| X42 | Y42 | Z42 | 30.267 | 82.999347 |
| X43 | Y43 | Z43 | 30.236 | 82.9278265 |
| X44 | Y44 | Z44 | 30.231 | 82.9161717 |
| X45 | Y45 | Z45 | 30.211 | 82.9161716 |
| X46 | Y46 | Z46 | 30.211 | 82.8669657 |
| X47 | Y47 | Z47 | 30.193 | 82.8231613 |
| X48 | Y48 | Z48 | 30.188 | 82.8231613 |
| X49 | Y49 | Z49 | 30.188 | 82.8103652 |
| X50 | Y50 | Z50 | 30.182 | 82.7949826 |
| X51 | Y51 | Z51 | 30.172 | 82.7949826 |
| X52 | Y52 | Z52 | 30.172 | 82.7704206 |
| X53 | Y53 | Z53 | 30.154 | 82.7221752 |
| X54 | Y54 | Z54 | 30.145 | 82.6989278 |
| X55 | Y55 | Z55 | 30.109 | 82.6004421 |
| X56 | Y56 | Z56 | 30.109 | 82.6004421 |
| X57 | Y57 | Z57 | 30.109 | 82.5998025 |
| X58 | Y58 | Z58 | 30.081 | 82.5215336 |
| X59 | Y59 | Z59 | 30.08 | 82.5215336 |
| X60 | Y60 | Z60 | 30.08 | 82.5204012 |
| X61 | Y61 | Z61 | 30.047 | 82.4223153 |
| X62 | Y62 | Z62 | 30.037 | 82.4223152 |
| X63 | Y63 | Z63 | 30.037 | 82.3926777 |
| X64 | Y64 | Z64 | 30.029 | 82.3707481 |
| X65 | Y65 | Z65 | 30.014 | 82.3707481 |
| X66 | Y66 | Z66 | 30.014 | 82.3225576 |
| X67 | Y67 | Z67 | 30.007 | 82.3027607 |
| X68 | Y68 | Z68 | 30.005 | 82.3027607 |
| X69 | Y69 | Z69 | 30.005 | 82.2954184 |
| X70 | Y70 | Z70 | 29.997 | 82.2712994 |
| X71 | Y71 | Z71 | 29.993 | 82.2712994 |
| X72 | Y72 | Z72 | 29.993 | 82.258459 |
| X73 | Y73 | Z73 | 29.96 | 82.1528175 |
| X74 | Y74 | Z74 | 29.958 | 82.1528175 |
| X75 | Y75 | Z75 | 29.958 | 82.1480858 |
| X76 | Y76 | Z76 | 29.952 | 82.1266986 |
| X77 | Y77 | Z77 | 29.942 | 82.1266986 |
| X78 | Y78 | Z78 | 29.942 | 82.0935959 |
| X79 | Y79 | Z79 | 29.923 | 82.0300972 |
| X80 | Y80 | Z80 | 29.915 | 82.0057523 |
| X81 | Y81 | Z81 | 29.915 | 82.0051106 |
| X82 | Y82 | Z82 | 29.901 | 82.0051106 |
| X83 | Y83 | Z83 | 29.901 | 81.9565135 |
| X84 | Y84 | Z84 | 29.89 | 81.9182115 |
| X85 | Y85 | Z85 | 29.885 | 81.9182115 |
| X86 | Y86 | Z86 | 29.885 | 81.9001068 |
| X87 | Y87 | Z87 | 29.858 | 81.8058797 |
| X88 | Y88 | Z88 | 29.855 | 81.8058797 |
| X89 | Y89 | Z89 | 29.855 | 81.7946998 |
| X90 | Y90 | Z90 | 29.844 | 81.757571 |
| X91 | Y91 | Z91 | 29.834 | 81.757571 |
| X92 | Y92 | Z92 | 29.834 | 81.720742 |
| X93 | Y93 | Z93 | 29.828 | 81.698315 |
| X94 | Y94 | Z94 | 29.823 | 81.698315 |
| X95 | Y95 | Z95 | 29.823 | 81.6791706 |
| X96 | Y96 | Z96 | 29.812 | 81.6394203 |
| X97 | Y97 | Z97 | 29.812 | 81.6394202 |
| X98 | Y98 | Z98 | 29.812 | 81.6387048 |
| X99 | Y99 | Z99 | 29.772 | 81.4904461 |
| X100 | Y100 | Z100 | 29.77 | 81.4815631 |
| X101 | Y101 | Z101 | 29.752 | 81.4119061 |
| X102 | Y102 | Z102 | 29.751 | 81.4119061 |
| X103 | Y103 | Z103 | 29.751 | 81.4090656 |
| X104 | Y104 | Z104 | 29.732 | 81.3337476 |
| X105 | Y105 | Z105 | 29.73 | 81.3337476 |
| X106 | Y106 | Z106 | 29.73 | 81.3273069 |
| X107 | Y107 | Z107 | 29.718 | 81.2791408 |
| X108 | Y108 | Z108 | 29.717 | 81.276571 |
| X109 | Y109 | Z109 | 29.695 | 81.1898352 |
| X110 | Y110 | Z110 | 29.692 | 81.1898352 |
| X111 | Y111 | Z111 | 29.692 | 81.1774201 |

TABLE 2-continued

| Design Variable | | | Objective Function | |
|---|---|---|---|---|
| Am | P1 | P2 | Efficiency (η) | Noise (SPL · dB(A)) |
| X112 | Y112 | Z112 | 29.668 | 81.0786783 |
| X113 | Y113 | Z113 | 29.66 | 81.0786783 |
| X114 | Y114 | Z114 | 29.66 | 81.046998 |
| X115 | Y115 | Z115 | 29.647 | 80.9929066 |
| X116 | Y116 | Z116 | 29.646 | 80.9929064 |
| X117 | Y117 | Z117 | 29.646 | 80.9891169 |
| X118 | Y118 | Z118 | 29.621 | 80.8821232 |
| X119 | Y119 | Z119 | 29.615 | 80.8821231 |
| X120 | Y120 | Z120 | 29.615 | 80.8578277 |
| X121 | Y121 | Z121 | 29.613 | 80.847616 |
| X122 | Y122 | Z122 | 29.602 | 80.847616 |
| X123 | Y123 | Z123 | 29.602 | 80.7998398 |
| X124 | Y124 | Z124 | 29.587 | 80.7337917 |
| X125 | Y125 | Z125 | 29.584 | 80.7240269 |
| X126 | Y126 | Z126 | 29.561 | 80.6193814 |
| X127 | Y127 | Z127 | 29.557 | 80.6034128 |
| X128 | Y128 | Z128 | 29.545 | 80.5483062 |
| X129 | Y129 | Z129 | 29.541 | 80.5483062 |
| X130 | Y130 | Z130 | 29.541 | 80.532873 |
| X131 | Y131 | Z131 | 29.525 | 80.4615232 |
| X132 | Y132 | Z132 | 29.523 | 80.4615232 |
| X133 | Y133 | Z133 | 29.523 | 80.4527967 |
| X134 | Y134 | Z134 | 29.515 | 80.4137528 |
| X135 | Y135 | Z135 | 29.514 | 80.4137528 |
| X136 | Y136 | Z136 | 29.514 | 80.4088387 |
| X137 | Y137 | Z137 | 29.493 | 80.316339 |
| X138 | Y138 | Z138 | 29.493 | 80.316339 |
| X139 | Y139 | Z139 | 29.493 | 80.312363 |
| X140 | Y140 | Z140 | 29.484 | 80.2720951 |
| X141 | Y141 | Z141 | 29.484 | 80.2720951 |
| X142 | Y142 | Z142 | 29.484 | 80.270587 |
| X143 | Y143 | Z143 | 29.465 | 80.183932 |
| X144 | Y144 | Z144 | 29.464 | 80.183932 |
| X145 | Y145 | Z145 | 29.464 | 80.1814693 |
| X146 | Y146 | Z146 | 29.46 | 80.1602507 |
| X147 | Y147 | Z147 | 29.459 | 80.1602507 |
| X148 | Y148 | Z148 | 29.459 | 80.1572512 |
| X149 | Y149 | Z149 | 29.441 | 80.0724229 |
| X150 | Y150 | Z150 | 29.441 | 80.0724229 |
| X151 | Y151 | Z151 | 29.441 | 80.0681446 |
| X152 | Y152 | Z152 | 29.42 | 79.969017 |
| X153 | Y153 | Z153 | 29.416 | 79.9522104 |
| X154 | Y154 | Z154 | 29.403 | 79.8887543 |
| X155 | Y155 | Z155 | 29.398 | 79.8887543 |
| X156 | Y156 | Z156 | 29.398 | 79.8619606 |
| X157 | Y157 | Z157 | 29.385 | 79.7984225 |
| X158 | Y158 | Z158 | 29.37 | 79.7243407 |
| X159 | Y159 | Z159 | 29.367 | 79.7114422 |
| X160 | Y160 | Z160 | 29.356 | 79.6572799 |
| X161 | Y161 | Z161 | 29.351 | 79.6305195 |
| X162 | Y162 | Z162 | 29.349 | 79.6305195 |
| X163 | Y163 | Z163 | 29.349 | 79.6196693 |
| X164 | Y164 | Z164 | 29.333 | 79.5376174 |
| X165 | Y165 | Z165 | 29.327 | 79.5376174 |
| X166 | Y166 | Z166 | 29.327 | 79.5109327 |
| X167 | Y167 | Z167 | 29.292 | 79.3289859 |
| X168 | Y168 | Z168 | 29.29 | 79.3221988 |
| X169 | Y169 | Z169 | 29.278 | 79.2594319 |
| X170 | Y170 | Z170 | 29.277 | 79.2594319 |
| X171 | Y171 | Z171 | 29.277 | 79.2533121 |
| X172 | Y172 | Z172 | 29.227 | 78.9867782 |
| X173 | Y173 | Z173 | 29.227 | 78.986778 |
| X174 | Y174 | Z174 | 29.227 | 78.9865995 |
| X175 | Y175 | Z175 | 29.204 | 78.8663784 |
| X176 | Y176 | Z176 | 29.203 | 78.8612056 |
| X177 | Y177 | Z177 | 29.183 | 78.7519735 |
| X178 | Y178 | Z178 | 29.182 | 78.7458862 |
| X179 | Y179 | Z179 | 29.175 | 78.7088752 |
| X180 | Y180 | Z180 | 29.167 | 78.6610085 |
| X181 | Y181 | Z181 | 29.167 | 78.6606544 |
| X182 | Y182 | Z182 | 29.157 | 78.6606544 |
| X183 | Y183 | Z183 | 29.157 | 78.6053284 |
| X184 | Y184 | Z184 | 29.136 | 78.493905 |
| X185 | Y185 | Z185 | 29.134 | 78.493905 |
| X186 | Y186 | Z186 | 29.134 | 78.4773519 |
| X187 | Y187 | Z187 | 29.131 | 78.4626734 |

TABLE 2-continued

| Design Variable | | | Objective Function | |
|---|---|---|---|---|
| Am | P1 | P2 | Efficiency (η) | Noise (SPL · dB(A)) |
| X188 | Y188 | Z188 | 29.13 | 78.4561662 |
| X189 | Y189 | Z189 | 29.112 | 78.3558916 |
| X190 | Y190 | Z190 | 29.111 | 78.3518051 |
| X191 | Y191 | Z191 | 29.108 | 78.3360681 |
| X192 | Y192 | Z192 | 29.1 | 78.2894346 |
| X193 | Y193 | Z193 | 29.09 | 78.230936 |
| X194 | Y194 | Z194 | 29.088 | 78.2177256 |
| X195 | Y195 | Z195 | 29.07 | 78.1170001 |
| X196 | Y196 | Z196 | 29.069 | 78.1169998 |
| X197 | Y197 | Z197 | 29.069 | 78.1133521 |
| X198 | Y198 | Z198 | 29.059 | 78.0505559 |
| X199 | Y199 | Z199 | 29.049 | 77.9971649 |
| X200 | Y200 | Z200 | 29.015 | 77.7966686 |
| X201 | Y201 | Z201 | 29.014 | 77.7922567 |
| X202 | Y202 | Z202 | 28.998 | 77.6952289 |
| X203 | Y203 | Z203 | 28.997 | 77.6952288 |
| X204 | Y204 | Z204 | 28.997 | 77.6892224 |
| X205 | Y205 | Z205 | 28.989 | 77.6398967 |
| X206 | Y206 | Z206 | 28.988 | 77.639896 |
| X207 | Y207 | Z207 | 28.988 | 77.6371251 |
| X208 | Y208 | Z208 | 28.964 | 77.550832 |
| X209 | Y209 | Z209 | 28.94 | 77.5029929 |
| X210 | Y210 | Z210 | 28.915 | 77.4679489 |
| X211 | Y211 | Z211 | 28.907 | 77.459104 |
| X212 | Y212 | Z212 | 28.849 | 77.4048382 |
| X213 | Y213 | Z213 | 28.845 | 77.4016137 |
| X214 | Y214 | Z214 | 28.842 | 77.3993036 |
| X215 | Y215 | Z215 | 28.833 | 77.3930941 |
| X216 | Y216 | Z216 | 28.787 | 77.3647676 |
| X217 | Y217 | Z217 | 28.742 | 77.342861 |
| X218 | Y218 | Z218 | 28.711 | 77.3299637 |
| X219 | Y219 | Z219 | 28.708 | 77.3286827 |
| X220 | Y220 | Z220 | 28.656 | 77.3109567 |
| X221 | Y221 | Z221 | 28.648 | 77.3109567 |
| X222 | Y222 | Z222 | 28.648 | 77.3085502 |
| X223 | Y223 | Z223 | 28.554 | 77.2855233 |
| X224 | Y224 | Z224 | 28.553 | 77.2852977 |
| X225 | Y225 | Z225 | 28.495 | 77.2750232 |
| X226 | Y226 | Z226 | 28.483 | 77.2750232 |
| X227 | Y227 | Z227 | 28.483 | 77.2731263 |
| X228 | Y228 | Z228 | 28.473 | 77.2716347 |
| X229 | Y229 | Z229 | 28.388 | 77.2615579 |
| X230 | Y230 | Z230 | 28.344 | 77.2575197 |
| X231 | Y231 | Z231 | 28.298 | 77.2575197 |
| X232 | Y232 | Z232 | 28.298 | 77.2539949 |
| X233 | Y233 | Z233 | 28.216 | 77.2485304 |
| X234 | Y234 | Z234 | 28.183 | 77.2485304 |
| X235 | Y235 | Z235 | 28.183 | 77.246576 |
| X236 | Y236 | Z236 | 28.146 | 77.2444507 |
| X237 | Y237 | Z237 | 28.131 | 77.2444507 |
| X238 | Y238 | Z238 | 28.131 | 77.2436537 |
| X239 | Y239 | Z239 | 28.102 | 77.2420587 |
| X240 | Y240 | Z240 | 28.086 | 77.2420587 |
| X241 | Y241 | Z241 | 28.086 | 77.2412236 |
| X242 | Y242 | Z242 | 28.006 | 77.237066 |
| X243 | Y243 | Z243 | 28.006 | 77.237066 |
| X244 | Y244 | Z244 | 28.006 | 77.2370655 |
| X245 | Y245 | Z245 | 27.921 | 77.2328987 |
| X246 | Y246 | Z246 | 27.891 | 77.2328987 |
| X247 | Y247 | Z247 | 27.891 | 77.2314741 |
| X248 | Y248 | Z248 | 27.755 | 77.2251261 |
| X249 | Y249 | Z249 | 27.755 | 77.2251261 |
| X250 | Y250 | Z250 | 27.755 | 77.2251185 |
| X251 | Y251 | Z251 | 27.67 | 77.2212663 |
| X252 | Y252 | Z252 | 27.641 | 77.2212663 |
| X253 | Y253 | Z253 | 27.641 | 77.2199893 |
| X254 | Y254 | Z254 | 27.598 | 77.2180905 |
| X255 | Y255 | Z255 | 27.587 | 77.2180905 |
| X256 | Y256 | Z256 | 27.587 | 77.2175869 |
| X257 | Y257 | Z257 | 27.434 | 77.2109748 |
| X258 | Y258 | Z258 | 27.433 | 77.2109748 |
| X259 | Y259 | Z259 | 27.433 | 77.2109123 |
| X260 | Y260 | Z260 | 27.327 | 77.2064116 |
| X261 | Y261 | Z261 | 27.327 | 77.2064116 |
| X262 | Y262 | Z262 | 27.327 | 77.2064116 |
| X263 | Y263 | Z263 | 27.31 | 77.2060668 |
| X264 | Y264 | Z264 | 27.31 | 77.2060668 |

Here, Table 3 represents optimal design variations Am, P1, and P2 for clusters A, B, C, D, and E, i.e. groups in which both efficiency and nose are optimized. In this case, the reference shape has an efficiency η of 27.25 and an SPL of 79 dB(A).

TABLE 3

| | Design Variables | | |
|---|---|---|---|
| Design | Am | P1 | P2 |
| Reference Shape | 0.000 | 0.000 | 0.000 |
| Cluster A | 1 | 23.96992 | 37.72269 |
| Cluster B | 1 | 20.31293 | 26.94253 |
| Cluster C | 1.975457 | 18.18757 | 23.56059 |
| Cluster D | 3.27427 | 15.95297 | 18.60822 |
| Cluster E | 6.793103 | 12.29705 | 1.858063 |

Referring to Table 3, a design variable Am increases while design variables P1 and P2 decrease from an optimal point A to an optimal point E. Here, the decreasing gradient of P2 is greater than the decreasing gradient of P1. It can be appreciated from the trade-off analysis that, among the three design variables, Am has a proportional relationship, while each of P1 and P2 has an inverse proportional relationship.

Here, referring to the reference shape, Am, P1, and P2 are 0 (points designated with triangles in FIG. 6), since the inter-blade pitches thereof are equal. Referring to Cluster A, Am is 1, P1 is 23.96992, and P2 is 37.72269. Referring to Cluster B, Am is 1, P1 is 20.31293, and P2 is 26.94253. Referring to Cluster C, Am is 1.975457, P1 is 18.18757, and P2 is 23.56059. Referring to Cluster D, Am is 3.27427, P1 is 15.95297, and P2 is 18.60822. Referring to Cluster E, Am is 6.793103, P1 is 12.29705, and P2 is 1.858063.

Figure 7:
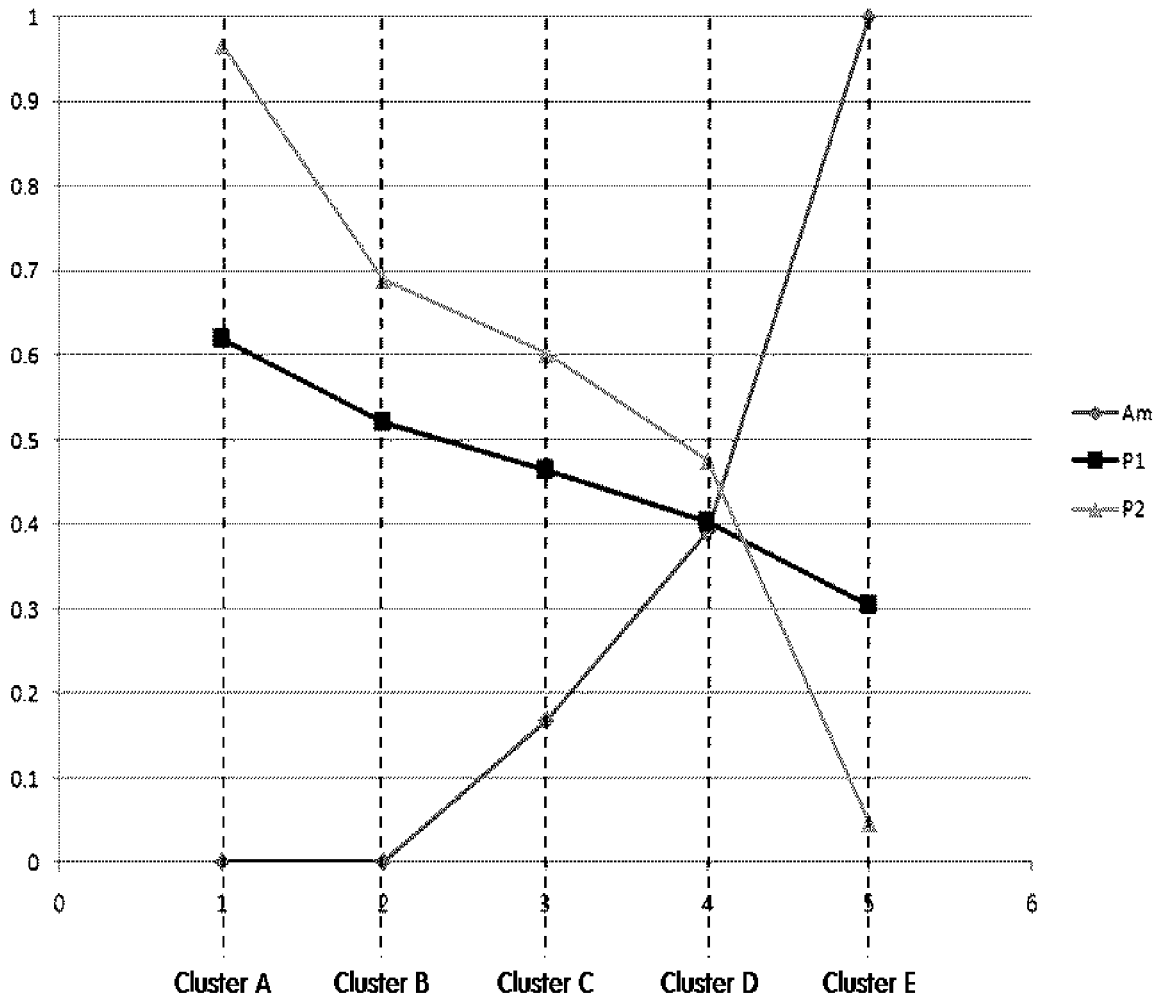
FIG. 7 is a graph illustrating correlations of design variables in the design optimization method for the regenerative blower according to the embodiment of the present disclosure.

Referring to FIGS. 6 and 7, the three optimal design variables can significantly change compared to the values of the reference shape, and the efficiency and noise are significantly improved at all of the optimal points. It is therefore possible to select a value of efficiency and a sound pressure level.

Therefore, it can be understood that the noise and efficiency increase from the optimal point A to optimal point E, the optimal point (COSs) A indicates the lowest noise level and efficiency, and the optimal point (COSs) E indicates the highest noise level and efficiency.

In the optimal solution comparison step S40 according to the embodiment of the present disclosure, it is examined whether or not the obtained optimal points are reliable by performing analysis of variance (ANOVA) and regression analysis on the response surfaces of the objective functions formed by the response surface method.

Table 4 represents the results of analysis of variance and regression analysis.

TABLE 4

| Objective Function | $R^2$ | $R^2_{adj}$ | Root-Mean-Square Error | Cross Verification Error |
|---|---|---|---|---|
| η | 0.977 | 0.948 | $4.73 \times 10^{-1}$ | $7.50 \times 10^{-1}$ |
| SPL | 0.898 | 0.933 | $5.49 \times 10^{-1}$ | $9.40 \times 10^{-1}$ |

Here, an $R^2$ value may indicate a correlation coefficient in least square surface fitting, while a $R^2_{adj}$ value may indicate an adjusted correlation coefficient in least square surface fitting. In this case, Ginuta explained that the $R^2_{adj}$ value ranges from 0.9 to 1 when a response model based on the response surface method is accurately predicted.

The root-mean-square error indicates a root-mean-square value of errors occurring in experiment or observation, while the cross verification error is a method of calculating predicted errors.

The $R^2_{adj}$ values of the efficiency and noise, i.e. the objective functions calculated in the optimal solution comparison step S40 according to the embodiment of the present disclosure, are 0.948 and 0.933, respectively. It can therefore be judged that the response surface is reliable.

In the regenerative blower and the design optimization method for the same according to embodiments of the present disclosure, the blades are arranged at unequal pitches by multi-objective optimization, thereby allowing efficiency and noise to be selectively adjusted.

Although the specific embodiments of the present disclosure have been described for illustrative purposes, the scope of the present disclosure is limited by no means to the foregoing embodiments of the present disclosure. A person skilled in the art could easily make many other embodiments by adding, modifying, omitting, supplementing elements without departing from the principle of the present disclosure.

INDUSTRIAL APPLICABILITY

The regenerative blower and the design optimization method for the same according to embodiments of the present disclosure are designed by multi-objective optimization, thereby allowing efficiency and noise to be selectively adjusted.

What is claimed is:

1. A regenerative blower comprising an impeller including a plurality of blades arranged in a circumferential direction to be spaced part from each other, wherein the plurality of blades are arranged such that angles therebetween are incremental angles ΔΘi satisfying the formula:

$$\Delta\theta_i = \left(\frac{360}{N}\right) + (-1)^i \times Am \times \mathrm{Sin}\left(P_i \times \frac{360}{N} \times i\right) \times \mathrm{Cos}\left(P_2 \times \frac{360}{N} \times i\right),$$

wherein

Am, P1, and P2 satisfy both relationships 27≤η≤32 and 77 dB(A)≤SPL≤83.7 dB(A), wherein $$\eta = (P_{out} - P_{in})Q/\sigma\omega, \text{ and}$$

$$\mathrm{SPL} = 10 \log_{10}(P/P_{ref})^2,$$

where η is efficiency, SPL is a sound pressure level (SPL), $(P_{out}-P_{in})$ is a total pressure, Q is a volumetric flow, σ is a torque, ω is an angular velocity, P is a sound pressure, and $P_{ref}$ is a reference pressure ($2\times10^{-5}$ Pa), wherein N is a total number of the plurality of blades, where N is a natural number greater than 2, Am is a distribution size of distances between the plurality of blades, the plurality of blades being spaced at equal angles, where 0°<Am<360°/N, i is a sequence of the plurality of blades, where i=1, 2, 3, 4, . . . , and N, and P1 and P2 are factors having an effect on a period, where 0≤P1≤N, and 0≤P2≤N, P1 and P2 being real numbers.

2. The regenerative blower according to claim 1, wherein Am ranges from 1° to 8.23°.

3. The regenerative blower according to claim 1, wherein P1 ranges from 1 to 38, and P2 ranges from 0 to 39.

4. A design optimization method for the regenerative blower as claimed in claim 1, the design optimization method comprising:

a design variable and objective function selection step;

a design area setting step of determining upper and lower limits of design variables; and a step of obtaining optimal solutions for objective functions in the design area, wherein the step of obtaining the optimal solutions for the objective functions in the design area comprises:

determining a plurality of test points by Latin hypercube sampling in the design area; and obtaining the objective functions at the plurality of test points by an aerodynamic performance test and a noise test.

5. The design optimization method according to claim 4, further comprising a step of determining whether or not the optimal solutions, obtained in the step of obtaining the optimal solutions for the objective functions in the design area, are proper.

6. The design optimization method according to claim 4, wherein, in the design variable and objective function selection step, the design variables include Am, indicating the distribution size of the distances between the blades, and P1 and P2, indicating the factors having the effect on the period, and the objective functions include η, indicating the efficiency, and SPL, indicating the sound pressure level.

7. The design optimization method according to claim 4, wherein, in the design area setting step of determining the upper and lower limits of the design variables, Am ranges from 1 to 8.23, P1 ranges from 1 to 38, and P2 ranges from 0 to 39.

8. The design optimization method according to claim 4, wherein the step of obtaining the optimal solutions for the objective functions in the design area comprises obtaining response surfaces, on which the optimal solutions are to be calculated, using a response surface method.

9. The design optimization method according to claim 8, wherein, when the response surface method is used, a response surface analysis (RSA) model of the objective functions has function types as follows:

$$\eta \text{ is } -18.8659-17.9578Am-10.5773P1-21.7493P2+7.3846AmP1+17.3858AmP2-0.789P1P2+6.2258Am^2+11.0769P1^2+16.1141P2^2, \text{ and}$$

$$\mathrm{SPL} \text{ is } 84.2304+4.2557Am-11.8326P1-6.4429P2+8.2626AmP1+4.8169AmP2+5.9802P1P2-4.2959Am^2+4.7855P1^2+1.2078P2^2.$$

10. The design optimization method according to claim 9, wherein, after the step of obtaining the response surfaces, on which the optimal solutions are to be calculated, using the response surface method, the optimal solutions are able to maximize the objective functions, based on the response surfaces of the objective functions obtained by the response surface method, and are obtained using a multi-objective evolutionary algorithm.

11. The design optimization method according to claim 10, wherein, after the optimal solutions able to maximize the objective functions are obtained, more improved values of the optimal solutions are obtained by localized search for the objective functions, using sequential quadratic programming (SQP), which is a gradient-based search algorithm.

12. The design optimization method according to claim 5, wherein the step of determining whether or not the optimal solutions are proper comprises analysis of variance (ANOVA) and regression analysis on response surfaces of the objective functions obtained by a response surface method.

13. A design optimization method for the regenerative blower as claimed in claim 1, the design optimization method comprising:

a design variable and objective function selection step;

a design area setting step of determining upper and lower limits of design variables; and a step of obtaining optimal solutions for objective functions in the design area.

14. A design optimization method for the regenerative blower as claimed in claim 2, the design optimization method comprising:

a design variable and objective function selection step;

a design area setting step of determining upper and lower limits of design variables; and a step of obtaining optimal solutions for objective functions in the design area.

15. A design optimization method for the regenerative blower as claimed in claim 3, the design optimization method comprising:

a design variable and objective function selection step;

a design area setting step of determining upper and lower limits of design variables; and a step of obtaining optimal solutions for objective functions in the design area.

16. A design optimization method for the regenerative blower as claimed in claim 2, the design optimization method comprising:

a design variable and objective function selection step;

a design area setting step of determining upper and lower limits of design variables; and a step of obtaining optimal solutions for objective functions in the design area, wherein the step of obtaining the optimal solutions for the objective functions in the design area comprises:

determining a plurality of test points by Latin hypercube sampling in the design area; and obtaining the objective functions at the plurality of test points by an aerodynamic performance test and a noise test.

17. A design optimization method for the regenerative blower as claimed in claim 3, the design optimization method comprising:

a design variable and objective function selection step;

a design area setting step of determining upper and lower limits of design variables; and a step of obtaining optimal solutions for objective functions in the design area, wherein the step of obtaining the optimal solutions for the objective functions in the design area comprises:

determining a plurality of test points by Latin hypercube sampling in the design area; and obtaining the objective functions at the plurality of test points by an aerodynamic performance test and a noise test.

* * * * *